United States Patent [19]

Lester

[11] Patent Number: 5,031,652

[45] Date of Patent: Jul. 16, 1991

[54] ADAPTABLE CAMPING SHELTER

[76] Inventor: Lela S. Lester, Apt. #804, 2231 California St., NW., Washington, D.C. 20008

[21] Appl. No.: 522,000

[22] Filed: Aug. 14, 1990

Related U.S. Application Data

[63] Continuation of Ser. No. 304,586, Feb. 1, 1989, abandoned.

[51] Int. Cl.[5] ..... E04H 15/40

[52] U.S. Cl. ..... 135/104; 135/108; 135/116

[58] Field of Search ..... 135/88, 104, 106, 116, 135/102, 108

[56] References Cited

U.S. PATENT DOCUMENTS

| | | | |
|---|---|---|---|
| 379,274 | 3/1888 | Hamilton | 135/104 |
| 1,345,108 | 6/1920 | Schilling | 135/116 |
| 1,388,478 | 8/1921 | Nelson | 135/116 |
| 2,314,830 | 3/1943 | Hunter | 135/104 |
| 2,363,917 | 11/1944 | Waterman | 135/102 |
| 2,960,992 | 11/1960 | Klipfel | 135/116 |
| 3,051,185 | 8/1962 | Reynolds | 135/102 |
| 3,578,003 | 5/1971 | Everett | 135/116 |
| 3,848,279 | 11/1974 | Ipsen | 135/102 |
| 3,927,145 | 12/1975 | Schroeder | 135/102 |

FOREIGN PATENT DOCUMENTS

| | | | |
|---|---|---|---|
| 2252232 | 5/1974 | Fed. Rep. of Germany | 135/116 |
| 1096 | of 1855 | United Kingdom | 135/116 |
| 809621 | 2/1959 | United Kingdom | 135/102 |

*Primary Examiner*—Henry E. Raduazo
*Attorney, Agent, or Firm*—Joseph J. Zito

[57] ABSTRACT

A tubular, ribbed, elevatable sleeping shelter that is compressible to a size convenient for carrying by an individual. In its preferred form, the shelter has three circular, sectioned ribs, each having a removable, handle-like projection across the bottom which serves as an elevating means. Each rib is comprised of four sections, the top section being smaller in circumference to allow its partial insertion inside the hinged side sections for consolidation purposes. The ribs are separated by braces along each side and the floor, and a cover is provided for the floor braces. The angular shape of the brace connections serves to hold the structure upright. Rotatable floor connections and optional use of adjustment extensions ensure that the unit sets firmly on the ground and reduces the risk of warping of the brace connections. A cover encloses the circumference of the ribs and is secured at the bottom between the ribs and elevating projections. A closure at each end is attachable by means of a double zipper. Ventilation can be controlled from within. Assembly or disassembly can quickly and easily be achieved.

24 Claims, 10 Drawing Sheets

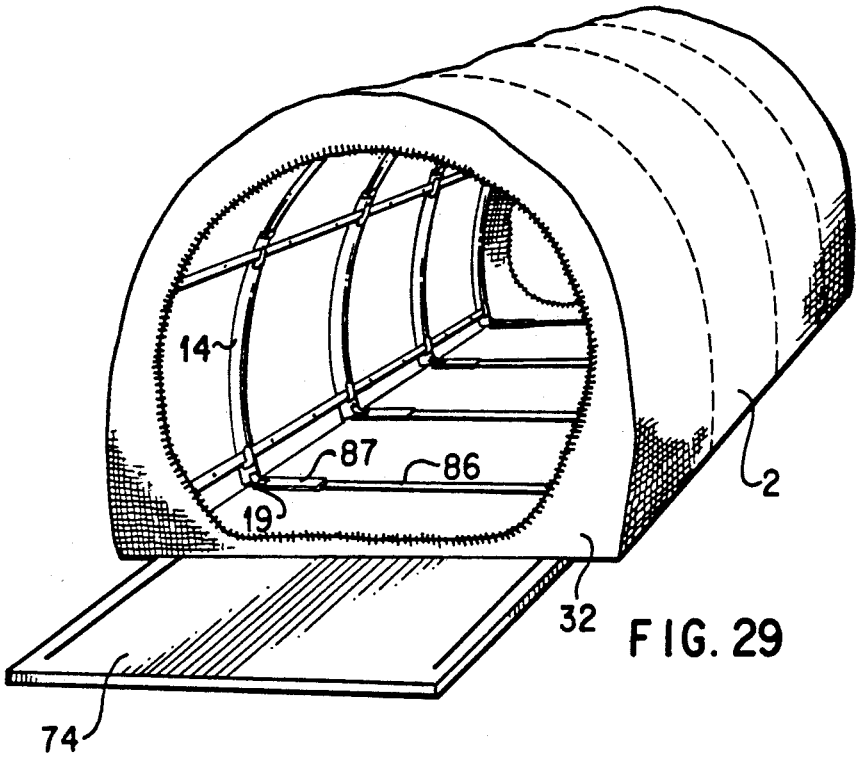
FIG. 29
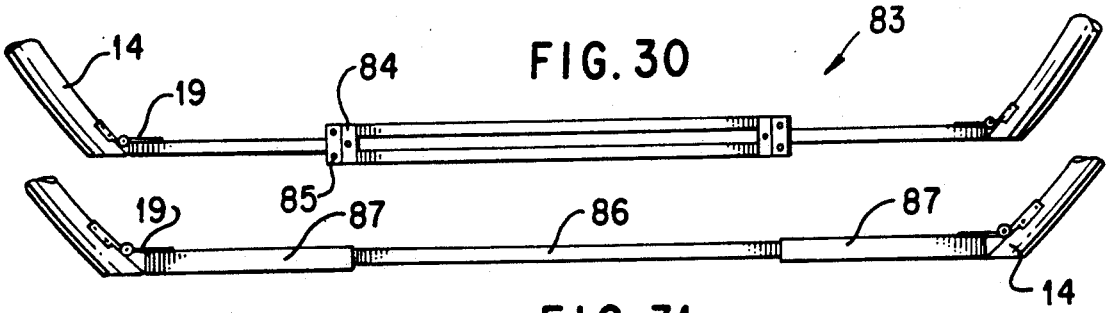
FIG. 30
FIG. 31
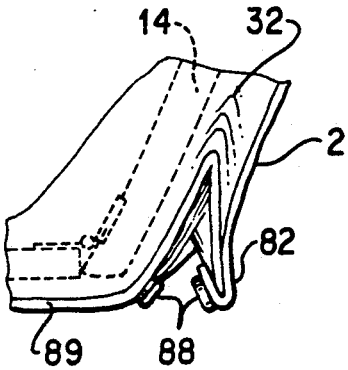
FIG. 32
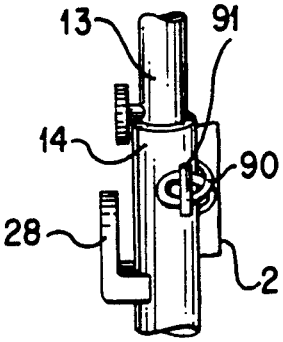
FIG. 33

ADAPTABLE CAMPING SHELTER

This is a continuation of application Ser. No. 07/304,586, filed Feb. 1, 1989 and now abandoned.

FIELD OF INVENTION

This invention relates generally to tent shelters and more particularly to a tubular, ribbed, elevatable sleeping shelter which can be quickly converted between a pitched position for use at a campsite and a collapsed condition in which it forms a compact, lightweight bundle for carrying.

DISCUSSION OF PRIOR ART

Various types of tent shelters for use by campers, hikers, hunters, etc., have heretofore been proposed. Most of these require the occupant to sleep at ground level and require the use of stakes and tie-down lines to hold the structure upright. Moreover, the parts of many tents have been of such character that they do not lend themselves to consolidation to a size suitable for carrying by a user, and many have included numerous small, separate parts which can be misplaced.

U.S. Pat. No. 3,929,145 to Shroeder discloses a collapsible, ribbed shelter adjustable between a form in which it can accommodate a sleeping camper and a compressed form in which it can be carried on a hiker's back. The ribs are constructed of curved strip material.

While the Shroeder tent has advantages over more conventional tents in certain respects, such as ease and speed of assembly and disassembly, it has some disadvantages in relation to the present invention. For example, the occupant is required to sleep at ground level with no special protection from frozen or muddy terrain. The tie-down line at each end inhibits entry and exit capabilities. Security of the tie-down lines can rather easily be compromised by an entity outside the shelter. No means is provided for reducing the circumference of the ribs to achieve a more compact carrying size.

U.S. Pat. No. 3,848,279 to Ipsen presents an elevated camping apparatus which encloses a cot and is contractable to a carrying size. U-shaped support legs are pivotally attached to the frame at each end and in the center. U-shaped arms to support a cover are pivotally connected to each end of the frame.

The Ipsen tent provides some advantages over more conventional tents, but also has disadvantages in relation to the present invention. For example, no provision is made for adjustment for varying ground levels underneath the structure, and warping of the frame could result. No provision is made for reduction in the width of the structure, leaving a bulky apparatus in its compressed state. The folded state must also accommodate the size of the cot, which adds considerably to the bulk, and the weight is also increased thereby.

OBJECTS

It is an object of this invention to provide an above-ground sleeping shelter that provides the occupant with extra protection from wet, cold, or frozen terrain.

A further object of this invention is to provide a lightweight sleeping shelter that can easily be carried in its compressed state by backpackers, bicyclists, homeless persons, hunters, etc.

A further object of this invention is to provide a sleeping shelter that requires no stakes or tie-down lines (except that stakes are used in extremely windy conditions).

A further object of this invention is to provide a sleeping shelter that is adaptable to a wide range of climatic conditions due to its above-ground feature and through use of various covering materials and a ground cover.

A further object of this invention is to provide an elevatable camping apparatus that is adjustable to varying ground levels underneath the structure.

A further object of this invention is to provide a camping apparatus that allows the occupant to control ventilation from within.

A further object of this invention is to provide a camping apparatus that comprises few small, separate parts, thereby reducing the risk of misplacement of necessary parts.

This invention provides a tubular-shaped, elevatable, collapsible shelter which has several advantages over the referenced inventions. In its preferred form, the shelter has three circular, sectioned ribs separated by braces along the sides and floor. (For consolidation purposes, the top rib section is partially inserted inside the side rib sections.) The angular shape of the brace connections serves to hold the structure upright and prevent its collapse toward one end or the other. A wide, handle-like projection attachable to the bottom of each rib serves as an elevating means. Optional adjustment extensions secured to the elevating projections provide a means for adjusting to varying ground levels underneath the shelter. The cover encloses the circumference of the ribs and is sewn together at the bottom center and secured between the ribs and the elevating projections. Each end closure is attachable by means of a double zipper. Assembly or disassembly can quickly and easily be achieved.

The shelter's tubular shape and above-ground feature eliminate the need for stakes or tie-down lines (except that stakes may be needed in unusually windy conditions). This also facilitates its use on hard surfaces such as rock. It is adaptable to a wide range of climatic conditions, providing extra protection from cold or wet terrain. In addition to the regular version, there could be a tropics version and an arctic version, using various covering materials and optional components to adapt to various climatic conditions. For example, a tropics version could utilize a waterproof material for the upper half of the cover and a ventilated material for the lower half, along with a firm ground cover for use in soft terrain. An arctic version might include a lining of material that preserves body heat, a firm ground cover, and the use of ground stakes to prevent being blown about by wind. The shelter can be used without elevating projections, in which case a firm ground cover may be needed.

Other objects, embodiments, features, and advantages of the invention will become apparent in light of the following.

DRAWINGS

With reference to the drawings, which may show only one example of the apparatus:

FIG. 29 is a view in perspective of a nonelevated version of the shelter showing more width at the bottom.

FIG. 30 is a view of an apparatus for expanding the bottom section of the rib, comprising strips placed side by side and secured with bands.

FIG. 31 is a view of an additional version of the means for expanding the bottom section of the rib, comprising a strip encased inside two shorter strips.

FIG. 32 is a view of the snaps for securing excess floor material in place.

FIG. 33 is a view of the loop attaching the cover to the side rib section.

DESCRIPTION/OPERATION

Figure 1:
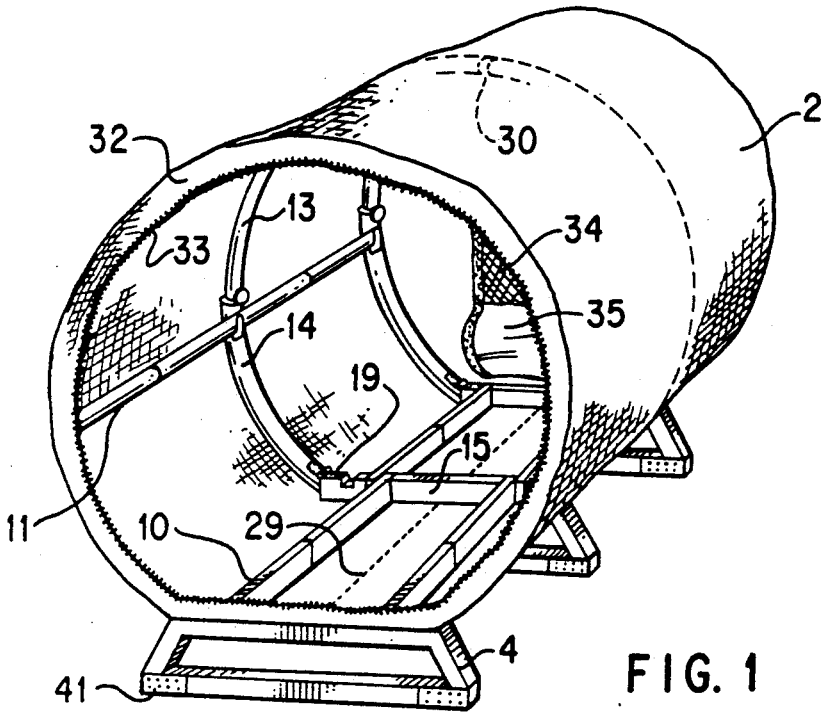
FIG. 1 is a view in perspective of the preferred form of the shelter.

Referring to the drawings in detail, there is illustrated in FIG. 1 the preferred form of this shelter in its pitched state. It is sized to comfortably accommodate a single occupant with an air mattress or a sleeping bag.

The shelter has a cover with a main tubular portion (2), and in its preferred form, three circular, sectioned ribs fixed securely in position around the inner wall of said tubular portion to hold that portion in proper shape to serve its function in the pitched position. The cover is formed from a lightweight, weatherproof fabric, preferably nylon tenting material. The three ribs are of equal diameter and are spaced an equal distance apart along the length of the pitched shelter, with one at each end of the tubular portion of the cover and one positioned between the two end ribs, as shown in FIG. 1.

Figure 9:
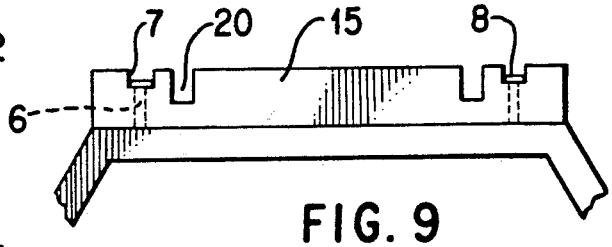
FIG. 9 is a side view of the apparatus used to hold the elevating projection to the rib.
Figure 11:
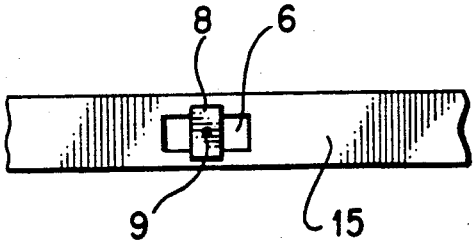
FIG. 11 is a top view of FIG. 9 in its secured position.

Each of the ribs has a removable elevating projection (4) underneath the entire bottom section (15), constructed of a sturdy, lightweight material. This projection is shaped to form a wide, handle-like structure, the top of which matches the width of the bottom section of the rib (15), but which is wider at its bottom to provide additional stability for the shelter. The projection is attached to the bottom section of the rib with two rectangular-shaped bolts (6) which are welded or molded to the top of the elevating projection and inserted through a reinforced hole in the cover and a matching rectangular-shaped opening (5) in the bottom rib section (see FIGS. 7 and 9). The bolt is inserted up to the level of an indention (7) in the rib, and is capped by a matching rectangular-shaped strip (8) attached to the top of the bolt (6) by a screw (9). To secure the elevating projection to the rib section, the strip at the top of the bolt is turned at a right angle to the projection (see FIG. 11), preventing the projection from falling off the bottom rib section. By turning the strip parallel to the projection, the elevating projection can also be removed, thereby reducing the size of the structure's compressed state (see FIG. 7).

The ribs are separated by braces (10) at the bottom of the enclosure and at each side (11), and are held in an upright position by the angular shape of the brace connections (12). The ribs are made of tubular material, except for the bottom portion (15), which is a length of rectangular-shaped material, and each is comprised of four sections (13), (14), and (15). Ribs and elevating projections can be constructed of fiberglass, plastic, aluminum, etc.

Figure 5:
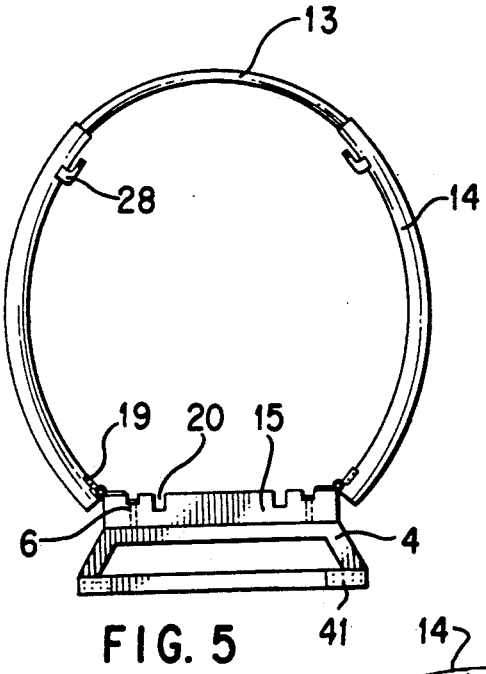
FIG. 5 is an enlarged view of the rib in its compressed state.
Figure 6:
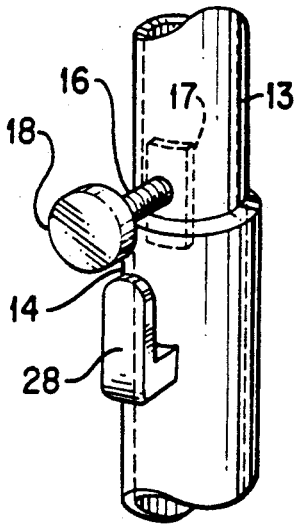
FIG. 6 is an enlarged view of the apparatus for holding the rib in an expanded position.

The longest section of the rib is the top half (13). It is constructed of curved, slightly flexible tubing which is smaller in circumference than the side rib sections (14) to facilitate its partial insertion inside the side sections for consolidation purposes (see FIG. 5). As the top section is partially inserted into the side sections, the tops of these side sections are pushed toward the center of the enclosure. When the top rib section is pulled out to its full range, it can be secured in place by means of a bolt (16) inserted in a hole near each end of the top section (13) (see FIG. 6). An oblong support strip (17) inside the rib is connected with a screw to said bolt (16), which is inserted through the hole. A convex cap (18) is molded to the outer end of the bolt. The cap is wider than the hole and the bolt, and the edge of the cap hooks over the top of the side rib section (14) to prevent the top section (13) from slipping into the side section. The cap is small enough so that, when the bolt is pushed in, the cap does not interfere with the partial insertion of the top rib section into the side rib section. All components of this bracing apparatus are made of metal.

The side sections (14) of the ribs are constructed of rigid, curved, tubular material. They are attached to the top rib section (13) by means of insertion of the top section into the side sections (see FIG. 5) to one degree or another, and are connected to the bottom rib section (15) with hinges (19).

The bottom section of the rib (15) is constructed of a rectangular-shaped length of strong, sturdy material, having two indentions (20) to connect with the matching angular portions (12) of the floor braces and two indentions that allow room to hold the strip (8) at the top of the elevating projection's bolt (6), the bolt being inserted through a hole at the bottom of this indention. The center rib, however, has an extra indention at each side since braces from each end of the shelter will connect with this rib.

Figure 2:
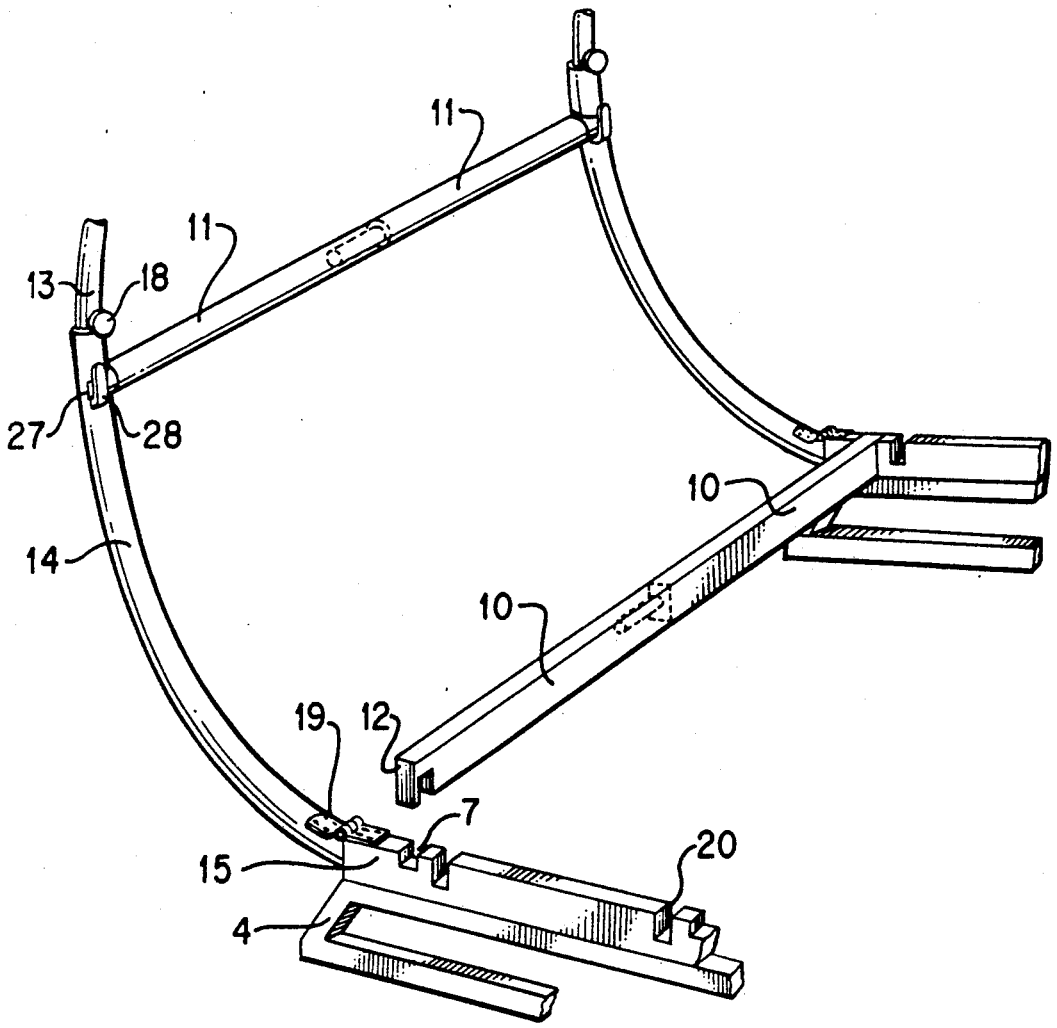
FIG. 2 is an enlarged view in perspective of the apparatus used to brace the floor and sides of FIG. 1.
Figure 10:
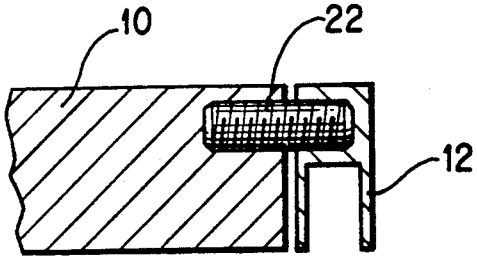
FIG. 10 is a cross-section view of the end of the floor brace used in FIGS. 1 and 19.

An enlarged view of the apparatus for bracing the floor area is shown in FIG. 2. The floor is braced by four two-section lengths of strong, rectangular-shaped material (10), each approximately 40" in length when the two sections are fitted together. The two sections of each of the four braces are joined together by inserting the smaller end of one section (20) inside the end of the other section (10). Two braces are placed between each two ribs, one at each side of the shelter, with the longer side of the brace placed in a vertical position. A U-shaped projection (12) attached to end of the brace by means of a screw-type bolt (22) (see FIG. 10) fits over the bottom section of the rib, which has an indention (20) for that purpose. This bolt allows the floor area to adjust to mild unevenness of the ground underneath the shelter so that the brace connections are not warped. The U-shaped projection (12) is thicker at its top than at its outer side to provide additional weightbearing support, as well as to encase the end of the bolt (see FIG. 10).

Figure 3:
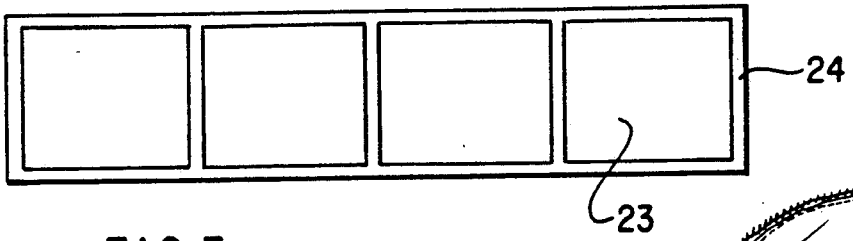
FIG. 3 is a view of the floor cover used with FIGS. 1 and 19.

The floor braces are covered by four sheets (23) of weightbearing material which are wide enough to cover the bottom section of the rib (15). Each sheet is approximately 19 inches long. These four sheets are arranged end to end, about one inch apart, and encased in foldable vinyl (24), as shown in FIG. 3.

The apparatus for bracing each side is shown in FIG. 2. Two two-section braces (11), constructed of a tubular length of material, are used at each side of the shelter, with one brace between each two ribs. The two sections of each brace are fitted together by inserting the smaller end of one section inside the end of the other section. An indented strip (27) is molded or welded to the ends of each brace. This strip is shaped to fit over another strip (28), having a matching indention, that is welded or molded vertically to the upper end of the side rib section on the inner side. (As an alternate to side braces, the same apparatus can be used at the top.)

Figure 8:
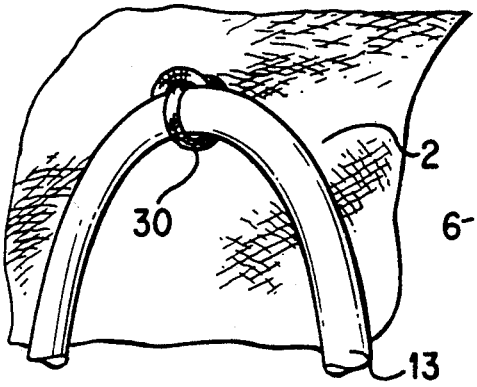
FIG. 8 is a view of the loop that attaches the cover to the rib.

The cover (2) encloses the circumference of the ribs, and is secured in place at the bottom between the elevating projection (4) and the bottom section (15) of the rib. A seam (29) is sewn along its length at the bottom center. A loop (30) of cover material sewn inside the cover (2) attaches the cover to the rib (13) at the top center (see FIG. 8). (If the shelter is braced at the top rather than the sides, a loop is placed at each side (31) just above the junction of the top and side rib sections (see FIG. 14.) A three-inch border (32) of cover material sewn to each end of the cover encircles each end opening at a right angle to the cover. A closure at each end is installed by means of a double zipper (33) which encircles the opening.

Figure 4:
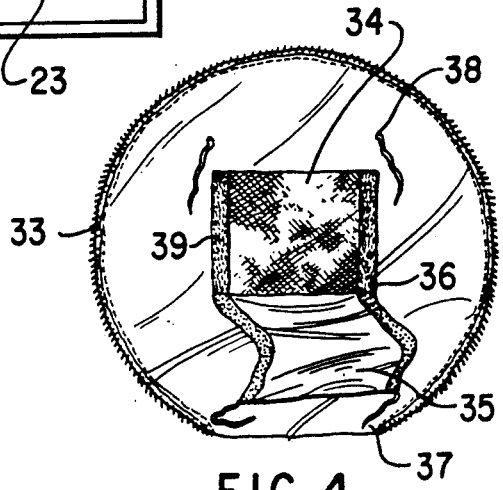
FIG. 4 is a view of the front/rear end closure.

Each end closure (FIG. 4) is identical. There is as are opening in the center of the closure provided with a screen (34) of nylon netting and a flap (35) of cover material that can be left in an open position for ventilation. The flap is sewn to the end closure along the lower edge (36) of the opening. This flap can be tied in a closed position with strings which are sewn to the upper corners (37) of the flaps and above the upper corners (38) of the opening. A strip of velcro (39) is sewn to each outer side of the flap and to each inner side of the opening to permit a tighter seal.

Figure 12:
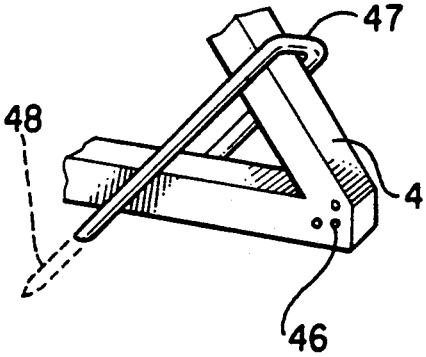
FIG. 12 is a view of the stake used for securing the elevating projection to the ground.
Figure 13:
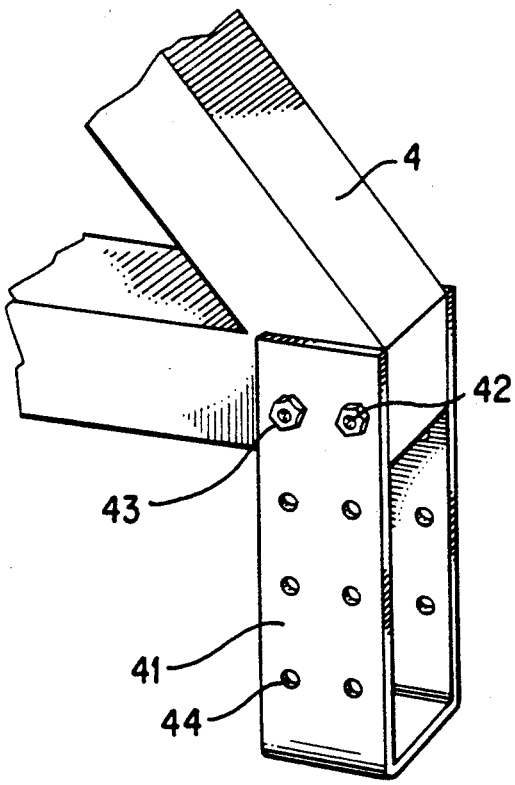
FIG. 13 is a view of the adjustment extension to be used underneath the elevating projection.

A means is provided for adjusting to varying ground levels underneath the shelter to ensure stability (see FIG. 13). The apparatus consists of a strip (41) of aluminum or fiberglass about an inch wide that is U-shaped to fit around or underneath a lower corner of the elevating projection (4), along with bolts (42) and lugs (43) for securing the apparatus in the desired position. Each side of the apparatus has eight holes (44), spaced to match holes on the other side, and three holes (46) are drilled through the corner area of the elevating projection, as shown in FIG. 12. To secure an adjustment extension in place, two bolts (42) are inserted into one side of the apparatus, extended through holes in the elevating projection, and extended through holes in the opposite side of the apparatus. Lugs (43) secure the bolts in place. This adjustment extension is secured to the elevating projection horizontally (see FIG. 1) when not needed or vertically see FIG. 13) to one degree or another when needed. An adjustment extension is secured to each side of each elevating projection.

Stakes, which are needed only in unusually windy conditions, consist of a round length of aluminum (47) which is bent into a U shape to fit over the end of the platform projection, as shown in FIG. 12. The ends of the stakes (48) are slightly sharpened for easy insertion in the ground.

Figure 7:
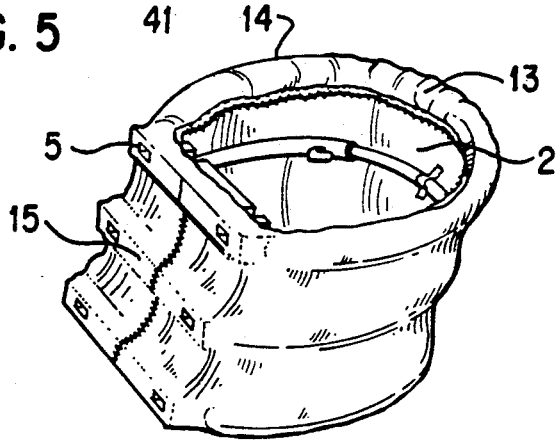
FIG. 7 is a view of the structure in its compressed state.

In its compact state, the shelter is approximately 18 inches wide, 24 inches long, and about 6 inches thick (See FIG. 7). It is expandable to 36 inches in diameter by 6½ feet long. Other sizes are optional. The enclosure can be assembled or disassembled quickly and easily by following step-by-step instructions.

The first step to assembly is to attach an elevating projection to the bottom of each rib. The ribs should be extended to their full range and secured in place by pulling out the bolt located near the end of each top rib section, and the shelter should be set upright and leaned against a stable object. The side (or top) braces and floor braces should be alternately attached to the ribs as the ribs are separated. [The side (or top) brace(s) used with the five- and seven-rib versions should be unfolded (see FIGS. 20 and 22) in advance of the expansion of each rib, the first rib pulled out to the full range, and the side (or top) braces secured to the rib. One section of the floor brace is then secured to the rib, the next side brace section is extended, etc.]

When all braces have been inserted and the unit is standing, the rear end closure can be zippered in, the floor cover added, and an air mattress or sleeping bag added as desired. (End closures can be zippered along the bottom and tucked inside the elevating projections until ready to fully close. They can be left permanently attached in this manner.)

For disassembly, the assembly process is reversed. End closures are unzipped and removed or tucked inside the elevating projection. Floor and side (or top) braces are removed from between two ribs and the first rib is pushed against the next rib, continuing until each rib section has been collapsed in accordian-like fashion. The bolt at each lower end of the top section of each rib is pressed into the rib, and the top rib section is inserted as far as possible into the side rib sections. Elevating projections are removed and placed inside the circle of the compressed ribs, along with folded or contracted braces and other attachments, to produce a neat, compact bundle (see FIG. 7) which can then be placed inside a carrying bag.

MODIFICATIONS

The hereinafter-described alternate versions of the floor area, as used with varying numbers of ribs, are shown in FIGS. 14, 17, 19, 21, and 24.

Figure 14:
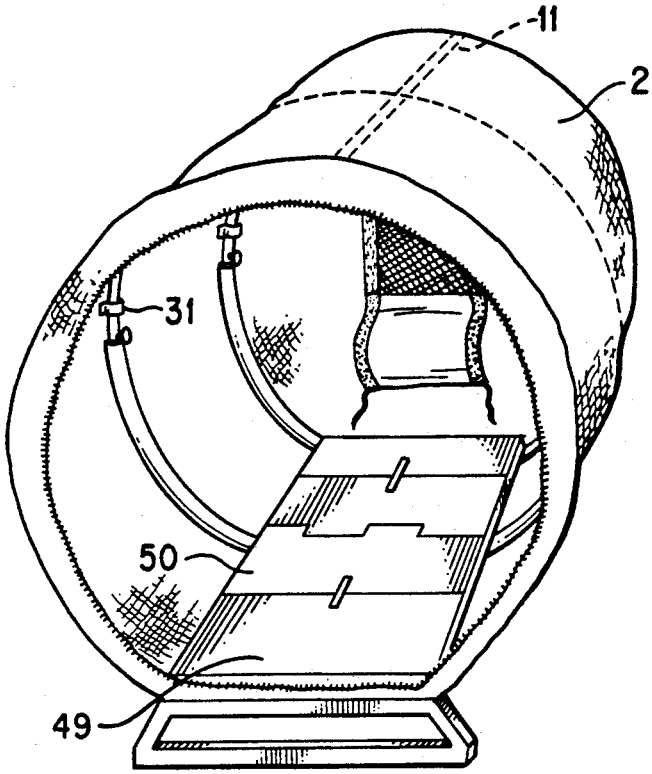
FIG. 14 is a view in perspective of an alternate three-rib version, showing a top brace and an expandable floor brace.
Figure 15:
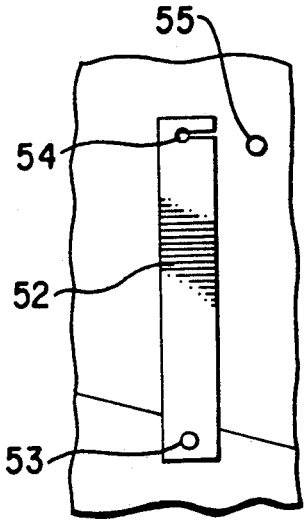
FIG. 15 is a view of the apparatus used to hold the floor brace of FIG. 14 in an expanded position.
Figure 16:
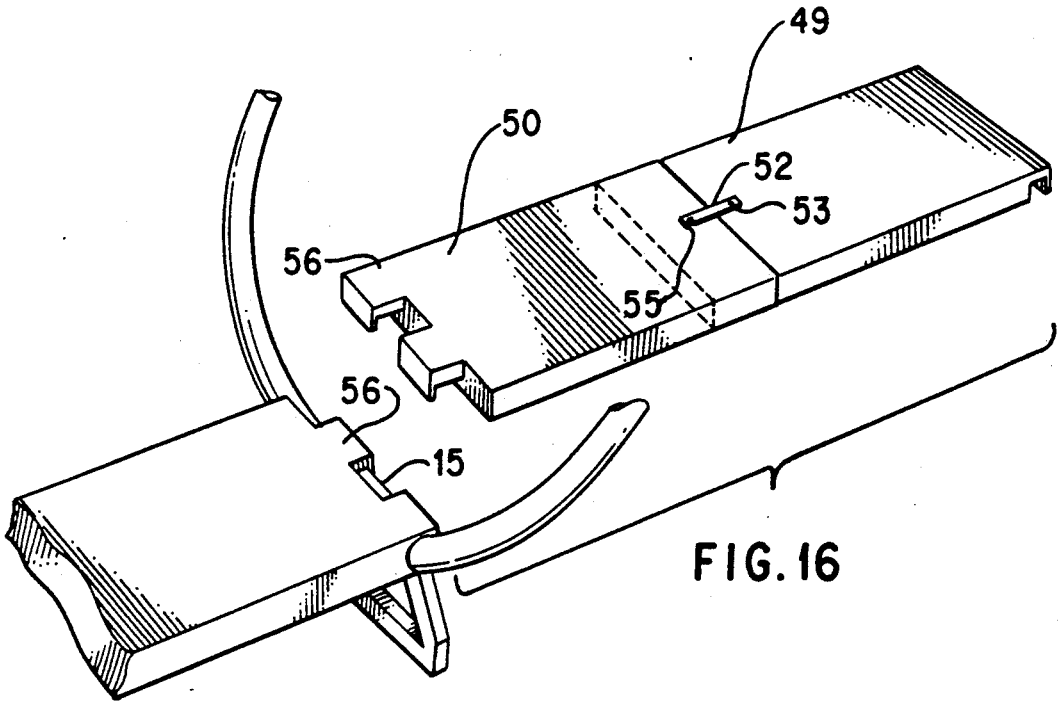
FIG. 16 is an enlarged view of the apparatus used to brace the floor of FIG. 14.

FIG. 14, a three-rib version, shows a floor brace which covers the entire width of the bottom section of the rib and eliminates the need for a separate floor covering. Two two-section braces are required (see FIG. 16). The brace consists of a solid sheet (49) or sturdy material inserted inside a sturdy, hollow, case-like apparatus (50) that is wide enough to cover the bottom section of the rib (15). When the inner, solid sheet is extended, the expanded apparatus covers the space between each two ribs. [In versions comprising more than three ribs (see FIG. 17, the brace consists of only one section rather than two, in which case it is a sheet (51) of sturdy material covering the width of the bottom section of the rib and extending from one rib to the next, as shown in FIG. 18.] The expansion is held in place by an indented strip (52) of thin, sturdy material about one inch wide (see FIG. 15). This strip is attached near one end of the outer, case-like part (50) of the brace by a rotating rivet (53), and rotates so that it extends over the connecting end of the smaller section of the brace (49). The indention (51) in the strip fits around a small projection (55) on the smaller section of the brace, thereby preventing contraction of the brace. Two downturned, U-shaped projections (56) are affixed intermittently along the width of each brace at one end by welding or molding. The bottom section of the center rib (15) is thereby covered intermittently by a U-shaped projection from a brace on one of its sides and by a U-shaped projection from a brace on its other side so that its entire width is covered by said projections—two areas from one side and two areas from the other side. The bottom section of each *end* rib, however, is entirely covered by one projection from its connecting end of a brace. The U-shaped projection is thicker at its top than its outer side to provide additional weightbearing support.

Figure 19:
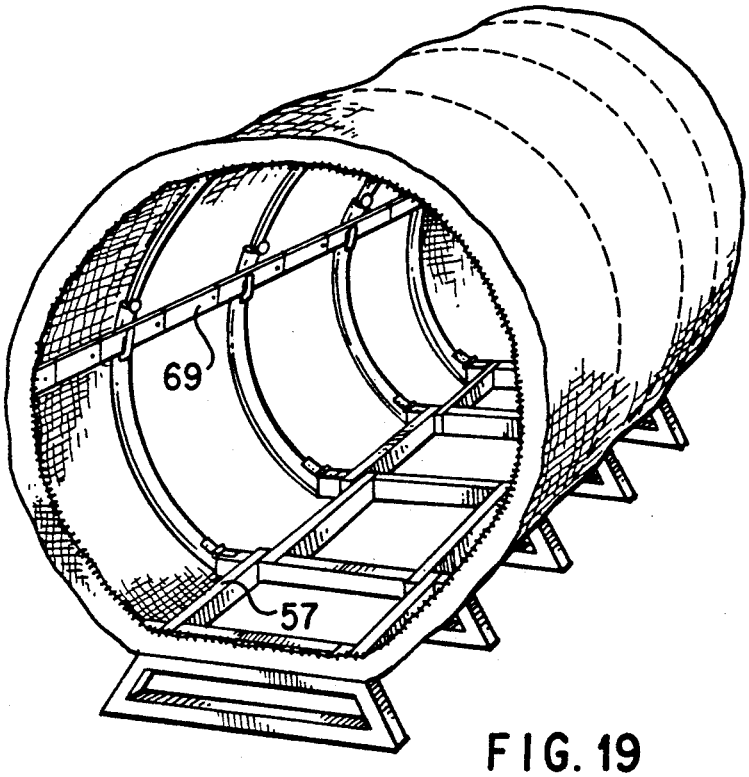
FIG. 19 is a view in perspective of an alternate version of FIG. 1 showing five ribs, a different side brace, and a different floor arrangement.
Figure 20:
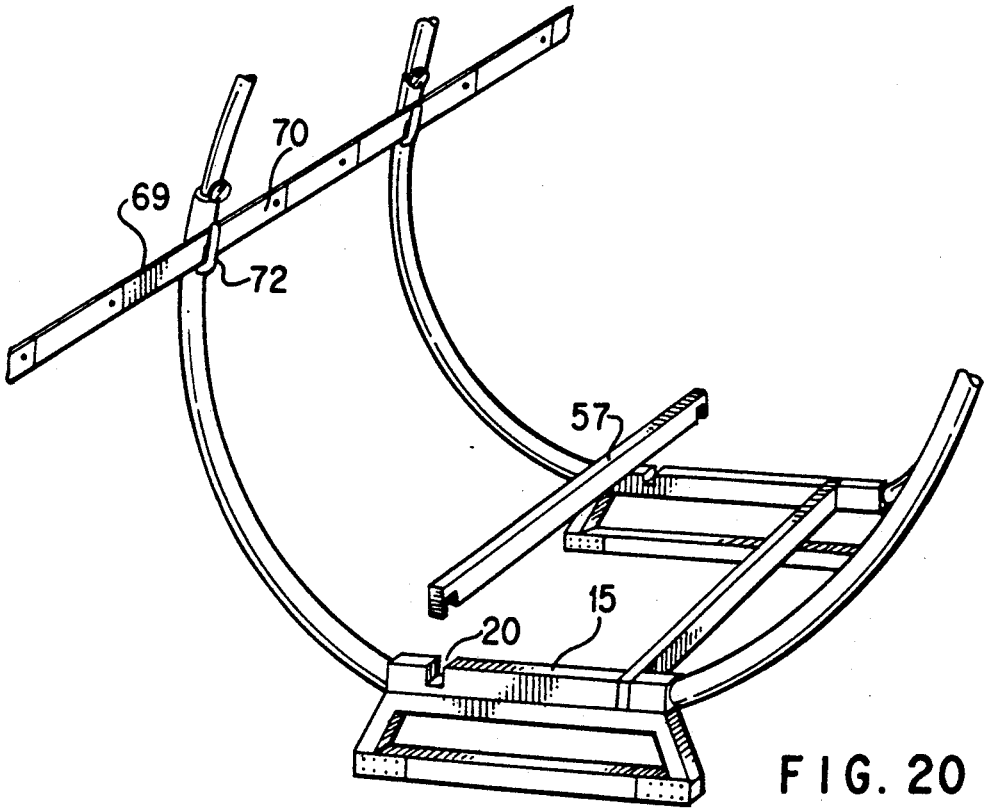
FIG. 20 is an enlarged view of the side and floor braces used in FIG. 19.

FIG. 19 is a five-rib version of FIG. 1. An enlarged view of the apparatus for bracing the floor area is shown in FIG. 20. In this version, the floor is braced by eight lengths of a rectangular-shaped, weightbearing material (57), each approximately 20 inches in length. Two braces are used between each two ribs. The ends of said braces are shaped to fit over the bottom portion of the rib (15), i.e., a U-shaped projection (12) is attached by a screw-type bolt to the ends of the braces (see FIG. 10), and fits over an indention (20) in the bottom section of the rib. The method of covering the floor braces is the same as for FIG. 1 (see FIG. 3).

Figure 21:
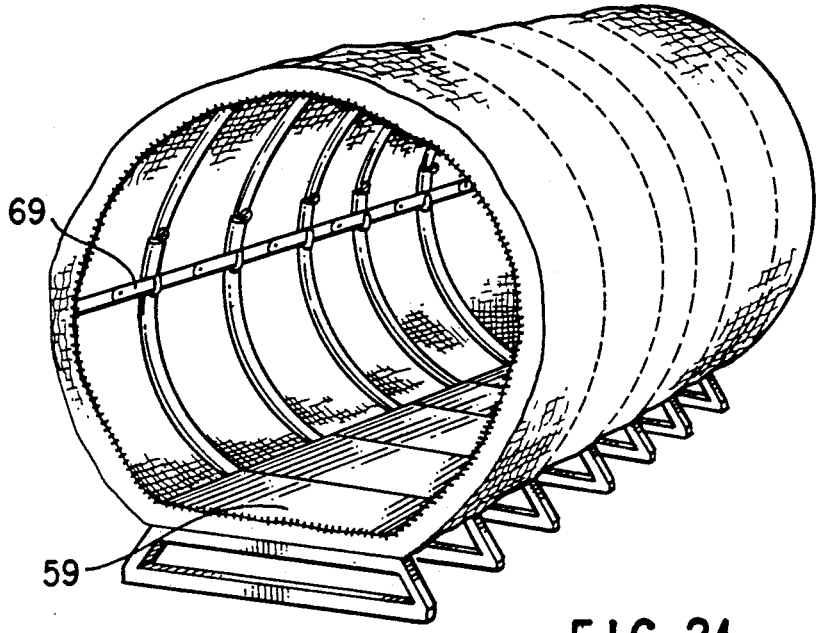
FIG. 21 is a view in perspective of an alternate version of the shelter showing seven ribs and a different floor arrangement.
Figure 22:
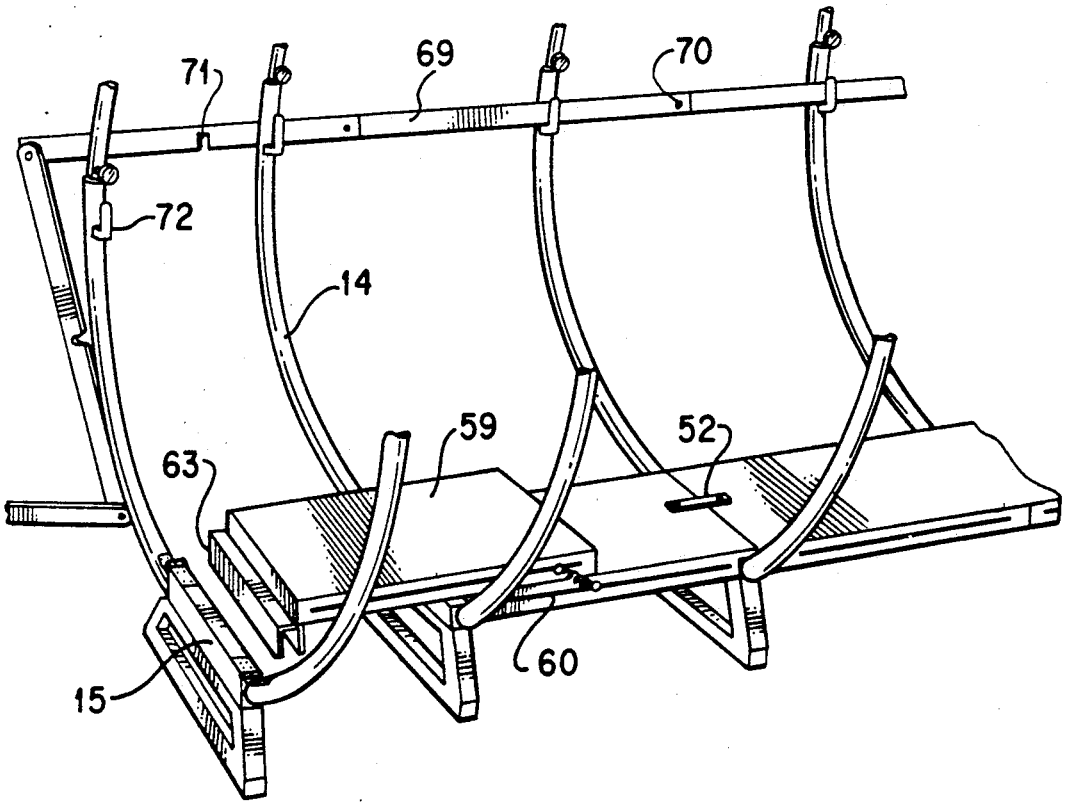
FIG. 22 is a view of the apparatus used to brace the floor and sides of FIG. 21, utilizing a sliding-lever-and-groove apparatus in the floor brace.
Figure 23:
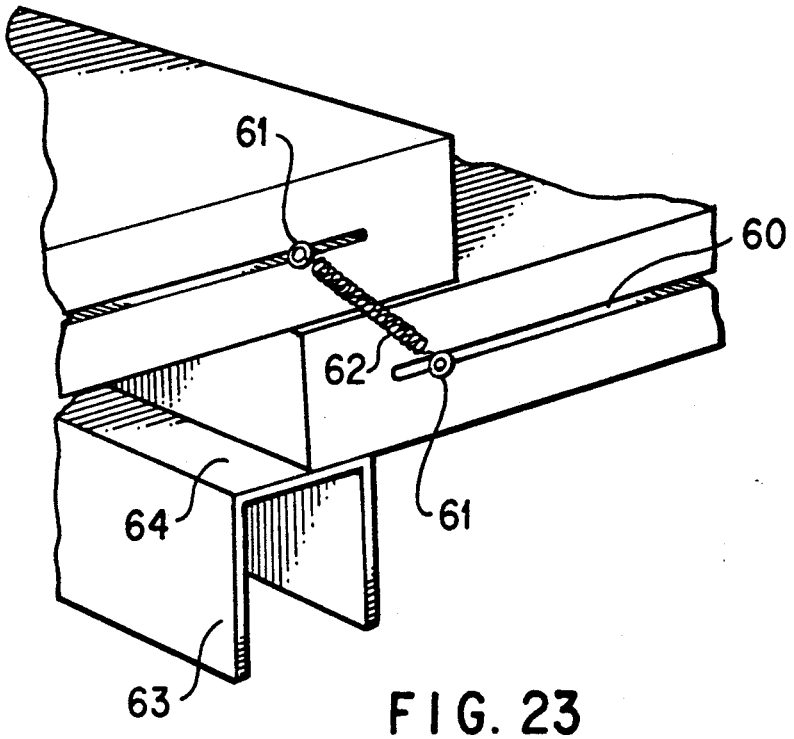
FIG. 23 is a second, enlarged view of the sliding-lever-and-groove apparatus used in the floor brace in FIG. 21.

FIG. 21 shows a contractable version of the floor brace to be used with a five- or seven-rib version. A detailed view is shown in FIG. 22. This comprises sections (59) of a weightbearing material (about an inch thick) which cover the width of the bottom section of the rib and extend from one rib to the next. The sections are connected to each other by means of a sliding-lever-and-groove apparatus (see FIG. 23). The ends of the sections, which fit closely together, serve as support to hold the structure upright. A groove (60) is molded into each side of each section of the floor brace, extending to about an inch of the end. A small knob (61) riveted to one end of a spring-type lever (62) is inserted inside the groove (60) and the lever's other end (61) is connected in like manner to the groove of the next section. By means of the sliding-lever action, one section of the brace can be raised above an adjacent section or extended to the end of an adjacent section. The spring (62) permits this to be accomplished smoothly. The sections are secured in position by a rotatable strip that extends from one section to the next (see FIG. 15) and hooks around a small projection on an adjacent section. A downturned U-shaped projection (63) is affixed underneath one end of each section of the brace by means of molding or screws, and fits over the entire bottom section of the rib. Half of this projection (64) extends beyond the end of the brace, so that the rib serves as a foundation for two floor section ends rather than one. Each end rib, however, is entirely covered by one projection, and the projection does not extend beyond the edge of the end floor section.

Figure 24:
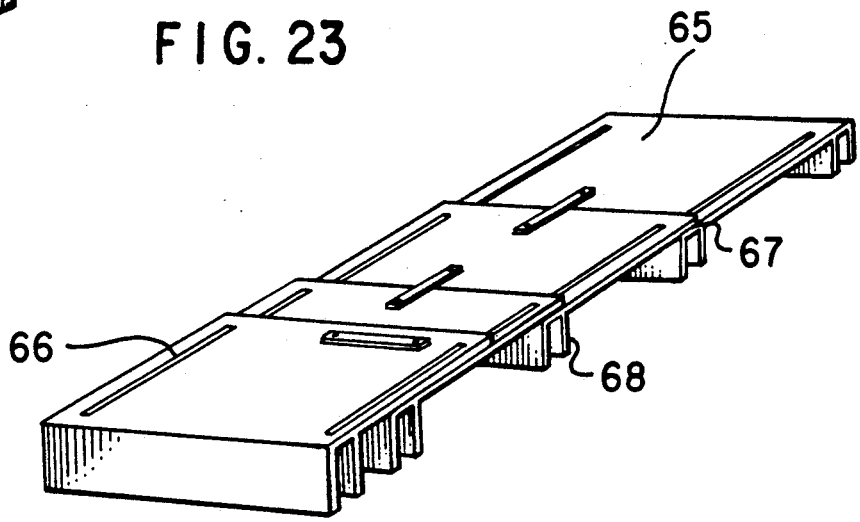
FIG. 24 shows an additional apparatus for bracing the floor of FIG. 21, utilizing sheets of sturdy material held together by grooves.
Figure 25:
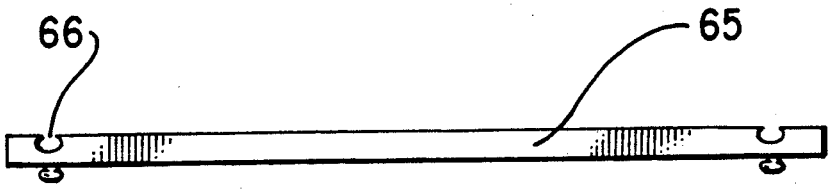
FIG. 25 is an end view of the floor section grooves in FIG. 24.

FIG. 24 shows a second contractable floor brace for use with the five- or seven-rib version (see also FIG. 21). It comprises sheets of weightbearing material (65), such as aluminum or fiberglass, that are wide enough to cover the bottom section of the rib (15). Each sheet extends from one rib to the next and the sheets are connected together by a downturned groove (66) near the edge along each side of each sheet, extending to within an inch of the end of the sheet. In the expanded position, the sheets overlap about two inches (67). The expansion is held in place by an indented strip (52) of thin, sturdy material about an inch wide (see FIG. 15). It is attached near the end of the upper sheet by a rotating rivet (53), and rotates so that it extends over the connecting end of the adjacent section of the brace. The indention fits around a small projection (55) on the lower sheet, thereby preventing the compression of the brace. Each sheet has a downturned, U-shaped projection (68) at one end, attached to the sheet by welding or molding, which covers the entire width of the bottom rib section. (One end sheet, however, has a projection at each end.)

The hereinafter-described alternate means of bracing the structure above floor level are shown in FIGS. 14, 17, 20, and 22.

For the five-rib version, each of the side braces consists of a single unit which is foldable in the manner of a carpenter's ruler (see FIG. 20 and 22). The apparatus consists of nine lengths of sturdy strip material connected end to end with rivets (70), forming a foldable strip that extends along the entire side of the shelter. The brace is held to the rib by means of indentions (71) on the brace, approximately 20 inches apart, that fit over projections (72) near the tops of the side sections of the rib. This projection is a flat strip, with an indention to match that of the brace, affixed vertically to the rib on its inner side by welding or molding.

For the seven-rib version shown in FIG. 21, the method of bracing each side is the same as for the five-rib version except that there are more indentions (71) on the brace (to match the number of ribs), occurring approximately every 13 inches rather than every 20 inches (see FIG. 22).

Figure 17:
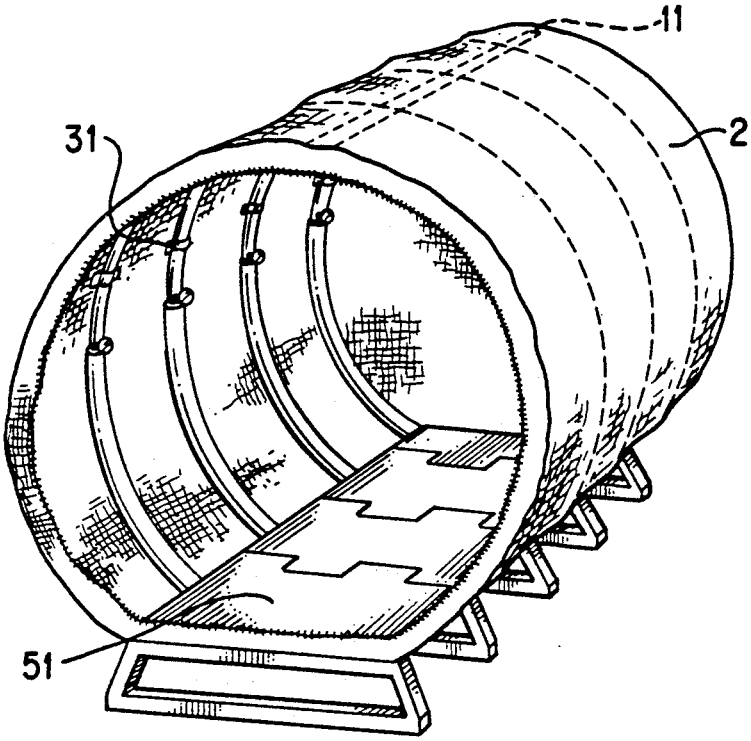
FIG. 17 is a view in perspective of an alternate version of FIG. 14, showing five ribs and a different floor arrangement.
Figure 18:
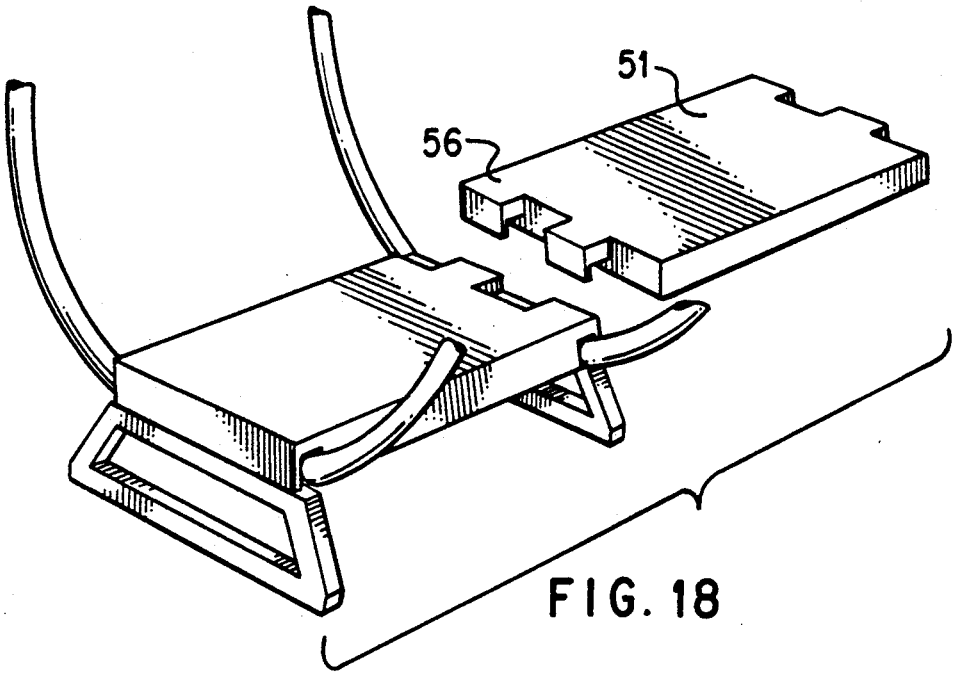
FIG. 18 is an enlarged view of the apparatus used to brace the floor of FIG. 17.

As an alternate to side braces, each apparatus described herein for bracing the sides can be used to brace the top center of the structure (see FIGS. 14 and 17). In such case, a loop (31) to hold the cover to the rib would be placed at each side of each rib just above the junction of the side and top rib sections rather than at the top center.

Figure 26:
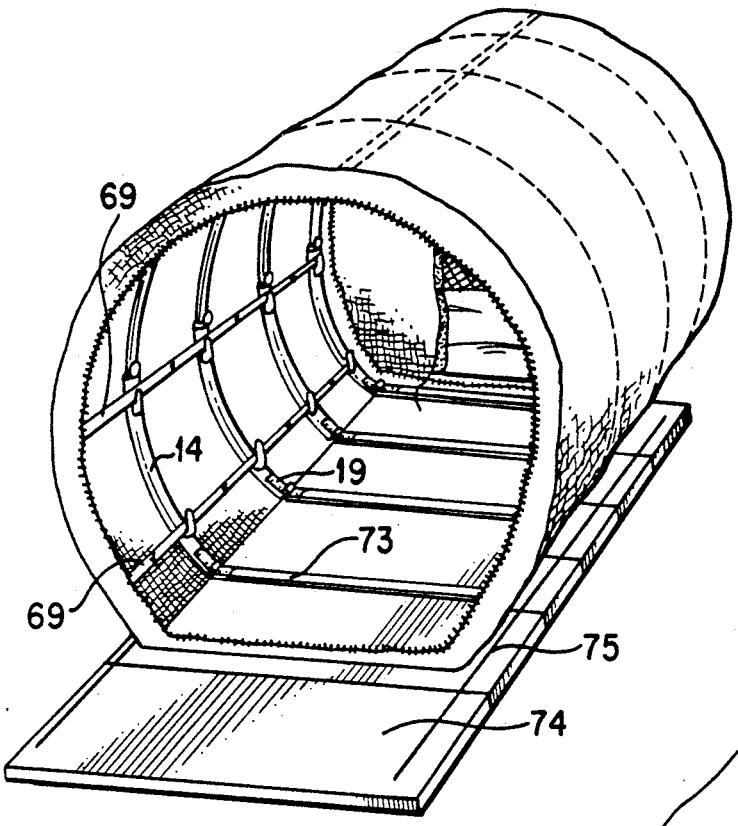
FIG. 26 is a view in perspective of a nonelevated version of the shelter, without floor braces and setting on a firm ground cover.

The foregoing descriptions have related mainly to elevated versions of the shelter. As mentioned earlier, the shelter can also be used without elevating projections, in which case a ground cover will be needed. FIG. 26 shows a nonelevated version of the shelter constructed the same as the foregoing versions in most respects. A major difference is that floor braces are no longer required, the bottom section of the rib being constructed of a flat strip of sturdy material (73) connected to the side rib sections (14) with hinges (19). This strip is attached to the floor cover material at the bottom by gluing. Each side of the shelter has an identical brace (69) at two points—just above the lower end of each side rib section and just below its upper end. The same brace is also used at the top center. As in previous versions, the angular shape of these brace connections serves to hold the unit upright. Without elevating projections, a different material is required underneath the unit—a strong but flexible vinyl reinforced with nylon netting (89). This is sewn between a fold (82) of the cover at the bottom of the side section of the rib along the length of the shelter on both sides.

A modification to the preceding version of the bottom section of the rib is to make this section expandable, thereby adding more width to the bottom of the shelter (see FIG. 29). In this case, this section is comprised of three flat strips of strong material (83) placed side by side and held together with aluminum bands (84) which are riveted (85) to the ends of the strips (see FIG. 30). The bands extend to enclose the adjacent strips, allowing room for the strips to be moved through the bands. The center strip is divided into two equal lengths which are attached to the side rib sections (14) with hinges (19). By pulling these two lengths apart, the user can expand the width of the shelter by about 7 inches on either side.

An alternate apparatus for expanding the bottom rib section is shown in FIG. 31. In this case, the bottom section of the rib is comprised of a flat strip of strong material (86), 18 inches long, encased in two hollow strips (87) of the same material, each 9 inches long. These shorter, hollow strips are placed end to end, enclosing the longer strip, and are attached to the side rib sections (14) with hinges (19). When the shorter strips are pulled apart, the longer strip is exposed and the width of the shelter is expanded by about 7 inches on either side. The strips are made of nonskid material that provides some traction to hold the expansion in place.

When the bottom rib section is in its nonexpanded position, approximately 7 inches of floor cover material on either side of the unit will fall into a slack position. This extra material can be secured at the lower side of the shelter (see FIG. 32) between the rib and cover with snaps (88) placed along the length of the shelter at the bottom of the side rib sections (14) and connecting snap means underneath the point on the floor cover (89) where the width of the shelter ends in its nonexpanded position. This extra material is pushed up against the side rib sections (14) along the length of the shelter inside the shelter's cover (2). The components of each snap are connected together along the lower edge of the fold of floor cover material (89).

The cover (2) is connected to the top of each side rib section (14) by a small loop (90) of cover material sewn to the cover at either side of the top of the side rib section (see FIG. 33). Said loop fits around a small T-shaped projection (91) that has been welded or molded to the rib (14) on either side near the cover (2). To be used with the version shown in FIG. 29, this loop-and-projection arrangement prevents the cover from becoming dislodged when the floor brace in in a nonexpanded position.

Figure 28:
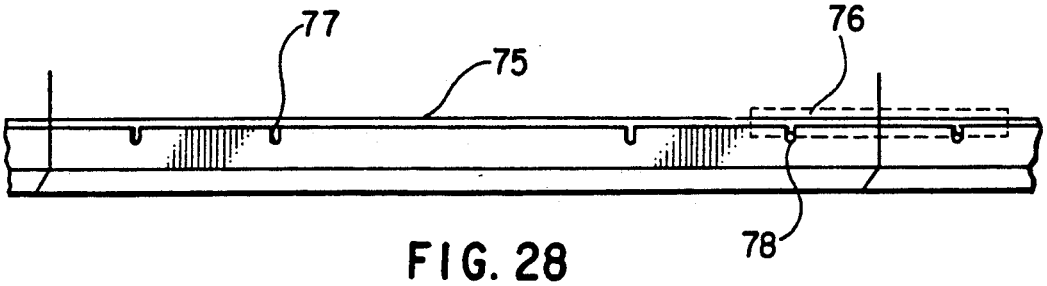
FIG. 28 is an enlarged view of the groove and bolt apparatus for holding the sections of the ground cover together.

The shelter may be placed on a firm ground cover which serves as a level foundation and a means of protection from unfavorable ground conditions. This cover comprises six (or more) sheets (74) of sturdy, lightweight material such as fiberglass (each approximately 18 inches by 24 inches, the thickness depending of the strength of the material used) placed side by side to form a ground cover that is approximately 24 inches wide and 9 feet long. A groove (75) along the top of each short side of each sheet near the edge houses a sliding bolt (76) which can be moved to a position so that the bolt connects two sheets together (see FIG. 28). Two indentions (77) in the groove provide a means for securing the bolt in position, as projections (78) on the bolt (76) are placed in the indentions.

Figure 27:
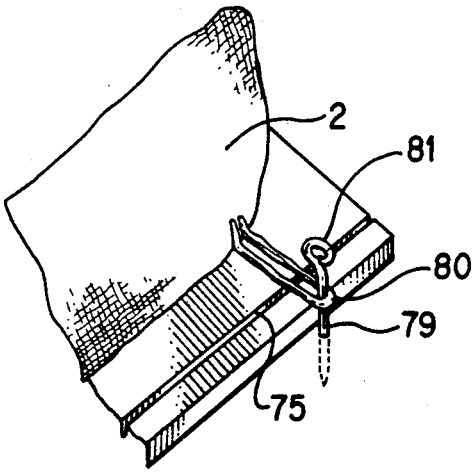
FIG. 27 is an enlarged view of the loop and stake which secure the shelter to the ground.

To secure the shelter to the ground during unusually windy conditions, a stake (79) is driven through a loop (80) of cover material that has been sewn to each corner of the shelter (see FIG. 27). This loop extends to a point just past the edge of the ground cover so that there is room to drive the stake through the loop and into the ground. The stake is a round, slender length of aluminum, the top of which is bent to form a vertical circle (81) to enable the user to grasp and easily remove it from the ground.

From the foregoing description and an examination of the attached drawings, it is seen that this invention provides a lightweight, elevatable sleeping shelter which is compressible to a convenient carrying size. When elevating projections are not used, a firm ground cover may be added for extra protection from wet, cold, or frozen terrain. These features make the shelter suitable for use under various climatic conditions, and various types of covering materials can be utilized to adapt to specific geographic areas. Ventilation can be controlled from within. The shelter comprises few small, detachable parts which could be misplaced.

It will be appreciated by those skilled in the art that this invention is not limited to the embodiments herein described and illustrated but is broad enough in concept to encompass all modifications thereof incorporative of the structural and functional essence of the invention. Certain of these modifications have already been mentioned, and others will occur to those skilled in the art in light of present disclosure. It is emphasized that the scope of the present invention includes all variant forms thereof encompassed by the language of the following claims.

The invention claimed is:

1. An adaptable structure manipulatable between an expanded configuration for forming a shelter, and a collapsed configuration for transport, said structure comprising:

a floor including a plurality of longitudinal and lateral members, each of said longitudinal members comprised of a plurality of separable sections and configured for attachment to said lateral members for longitudinally spacing said lateral members, a plurality of tubular ribs, each of said ribs formed into more than three-fourths of a circle, each said rib comprising a plurality of sections, including a top section and two side sections, said top section being resilient and configured for telescopic insertion into said side rib sections, allowing for reduction in both the height and width of said expanded configuration for ease of transport, each said rib having a first and a second end configured for attachment to one of said lateral floor members, wherein said rib ends are pivotally attached to said lateral floor member, the pivotal axis of said attachment oriented parallel to a common axis, further facilitating a decrease in the width of said structure upon insertion of said top rib section into said side rib sections, a plurality of rib braces for securing said ribs in a spaced apart configuration along a common axis, and a cover having attachment means for attaching said cover to said ribs for forming an enclosure, and having an aperture at at least one end of said enclosure fitted with removable flexible closure means which can be opened or closed from inside said shelter to permit movement through said aperture or provide protection from outside influences.

2. The shelter of claim 1, wherein said longitudinal floor members consist of lengths of elongated rectangular-shaped material with ends shaped to engage said lateral members.

3. An adaptable structure in accordance with claim 1, wherein said longitudinal floor members are comprised of sturdy, weightbearing planar material covering the area between said lateral members.

4. An adaptable structure in accordance with claim 3, wherein said longitudinal floor members are longitudinally expandable and contractable.

5. An adaptable structure in accordance with claim 4, wherein each of said longitudinal floor members includes a plurality of sections connected together by means of a sliding-lever-and-groove arrangement.

6. An adaptable structure in accordance with claim 4, wherein each of said longitudinal floor members includes a plurality of sections connected together by means of grooves.

7. An adaptable structure in accordance with claim 4, wherein each of said longitudinal floor members includes a plurality of sections, and further including a connecting strip for securing adjacent floor sections in expanded position, said strip material pivotally connected to one of said sections and having an indentation which fits around a small projection on said adjacent section.

8. An adaptable structure in accordance with claim 1, wherein said rib braces are comprised of strips of sturdy material riveted end to end and foldable in the manner of a carpenter's ruler, and having indentations that fit over projections on said ribs.

9. An adaptable structure in accordance with claim 1, wherein said rib is held in expanded position by means of a capped bolt inserted in an aperture near each end of said top rib section, the bolt being movable through the aperture so that its cap can extend over the top of said side rib section, thus preventing telescopic insertion of said top rib section into said side rib section.

10. An adaptable structure in accordance with claim 1, further comprising: a plurality of elevating support members for attachment beneath said floor, wherein said support members are detachable for consolidation purposes, said support members including a ground-engaging portion which extends laterally beyond said floor for providing lateral stability, said support members being attachable to said lateral floor members by means of bolts, with oblong rotatable caps, inserted through apertures in said lateral floor members.

11. An adaptable structure in accordance with claim 10, further comprising adjustment extensions attached to said support members for adjusting the support members to varying ground levels underneath the structure.

12. An adaptable structure in accordance with claim 11, wherein said adjustment extension consists of a U-shaped strip of sturdy material having holes on each side, shaped to fit around or underneath a corner of said elevating projection and secured in place with bolts and lugs.

13. An adaptable structure in accordance with claim 1, further comprising a thin, foldable floor cover comprising a plurality of sections of flat, rigid, weightbearing material placed end to end, separated by enough space for folding, and encased in flexible material, thereby providing a smooth covering for said floor members and additional support for the weight of an occupant of said shelter.

14. An adaptable structure in accordance with claim 1, in which said flexible closure means is fitted with zipper fastening means.

15. An adaptable structure in accordance with claim 1, in which said flexible closure means has a window opening fitted with a screen and a flexible flap which can be opened and closed.

16. An adaptable structure manipulatable between an expanded configuration for forming a shelter, and a collapsed configuration for transport, said structure comprising:

a floor including a plurality of lateral members, plurality of tubular ribs, each of said ribs formed into more than three-fourths of a circle, each said rib comprising a plurality of sections, at least one of said rib sections configured for telescopic insertion into said other section(s) of said rib, allowing for reduction in both the height and width of said expanded configuration for ease of transport, each said rib having a first and a second end configured for attachment to one of said lateral floor members, wherein said rib ends are pivotally attached to said lateral floor member, the pivotal axis of said attachment oriented parallel to a common axis, further facilitating a decrease in the width of said ribs upon insertion of said top rib section into said side rib sections, a plurality of rib braces for securing said ribs in a spaced apart configuration along a common axis, wherein said rib braces are comprised of strips of sturdy material riveted end to end and foldable in the manner of a carpenter's ruler, and having identations that fit over projections on the ribs, and a cover having attachment means for attaching said cover to said ribs for forming an enclosure, and having an aperture at at least one end of said enclosure fitted with removable flexible closure means which can be opened or closed from inside said shelter to permit movement through said opening(s) or provide protection from outside influences.

17. An adaptable structure in accordance with claim 16, wherein said lateral floor members are laterally expandable, thereby increasing the width at the bottom of the shelter.

18. An adaptable structure in accordance with claim 17, wherein said lateral floor members include a strip of material encased in two lengths of a hollow, nonskid material for lateral expansion of said lateral members.

19. An adaptable structure in accordance with claim 16, wherein said rib is held in expanded position by means of a capped bolt inserted in an aperture near each end of said top rib section, the bolt being movable through the aperture so that its cap can extend over the top of said side rib section, thus preventing telescopic insertion of said top rib section into said side rib section.

20. An adaptable structure in accordance with claim 16, further comprising a firm ground cover comprised of rectangular sections of flat, weightbearing material held together with movable bolts housed in grooves along each end of each said rectangular section, so that at least one long side of each said rectangular section is adjacent to a long side of another said rectangular section, whereby each said rectangular section extends by several inches the ground area covered, providing a supportive surface on which said structure can be placed for protection against unfavorable ground conditions.

21. An adaptable structure in accordance with claim 16, wherein said cover is expandable to encompass said shelter when said floor members are laterally expanded, including pairs of engagable members disposed along said cover in longitudinal direction for securing excess cover material when said lateral floor members are in nonexpanded position.

22. An adaptable structure in accordance with claim 16, in which said flexible closure means is fitted with zipper fastening means.

23. An adaptable structure in accordance with claim 16, in which said flexible closure means has a window opening fitted with a screen and a flexible flap which can be opened and closed.

24. An adaptable structure in accordance with claim 16, wherein said cover material beneath said floor is a strong, flexible vinyl reinforced with nylon netting and sewn to the upper portion of said cover longitudinally at each side of said shelter.

* * * * *